US009873965B2

(12) United States Patent
Hirasawa et al.

(10) Patent No.: US 9,873,965 B2
(45) Date of Patent: Jan. 23, 2018

(54) LOOP MATERIAL SEWING METHOD AND LOOP SEWING MACHINE

(71) Applicant: JUKI CORPORATION, Tokyo (JP)

(72) Inventors: Yutaka Hirasawa, Tokyo (JP); Liang Dong Lin, Tokyo (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 9 days.

(21) Appl. No.: 15/041,445

(22) Filed: Feb. 11, 2016

(65) Prior Publication Data

US 2016/0237605 A1 Aug. 18, 2016

(30) Foreign Application Priority Data

Feb. 16, 2015 (CN) ..... 2015 1 0083704

(51) Int. Cl.
*D05B 35/06* (2006.01)
*D05B 29/00* (2006.01)

(52) U.S. Cl.
CPC ..... *D05B 35/068* (2013.01); *D05B 29/00* (2013.01); *D05B 35/06* (2013.01)

(58) Field of Classification Search
CPC ..... D05B 35/02; D05B 35/04; D05B 35/06; D05B 35/066; D05B 35/068; D05B 29/00
See application file for complete search history.

(56) References Cited

U.S. PATENT DOCUMENTS 3,699,907 A * 10/1972 Anderson ..... D05B 35/068 112/104
4,048,931 A * 9/1977 Hodgins ..... D05B 35/068 112/104
4,137,857 A * 2/1979 Miyachi ..... D05B 35/068 112/470.34
4,279,209 A * 7/1981 Diacont, Jr. ..... D05B 35/068 112/104
6,035,793 A * 3/2000 Nishio ..... D05B 35/068 112/152
6,305,304 B1 * 10/2001 Tanaka ..... D05B 35/068 112/163

FOREIGN PATENT DOCUMENTS

FR 2369806 A1 * 6/1978
JP 2010-075382 A 4/2010

* cited by examiner

*Primary Examiner* — Ismael Izaguirre
(74) *Attorney, Agent, or Firm* — Drinker Biddle & Reath LLP

(57) ABSTRACT

The loop material sewing method includes: sewing one end of a loop material on a fabric in a state where a front side of the loop material faces the fabric; arranging a fork member including a pair of fork pins so as to arrange the loop material between the pair of fork pins; folding an opposite end of the loop material to a back side of the loop material by rotating the fork member around an axial line parallel to an extending direction of the pair of fork pins; relatively moving the fabric and the fork member in a length direction of the loop material; arranging the folded opposite end on the fabric, pulling out the fork pins from a folded portion at the opposite end by moving the fork member in a width direction of the loop material and sewing the folded opposite end on the fabric.

3 Claims, 8 Drawing Sheets

LOOP MATERIAL SEWING METHOD AND LOOP SEWING MACHINE

CROSS-REFERENCE TO RELATED APPLICATIONS

This application is based upon and claims the benefit of priority from Chinese Patent Application No. 201510083704.4, filed on Feb. 16, 2015; the entire contents of which are incorporated herein by reference.

BACKGROUND OF INVENTION

Field of the Invention

The present invention relates to a loop material sewing method and a loop sewing machine for sewing a loop material on a fabric.

Related Art

A loop sewing machine has been used to sew a loop material through which a belt passes on a fabric such as pants and skirts (for example, see JP-A-2010-075382).

The loop sewing machine includes a loop clamp that clamps the loop material and a fork member that folds an end of the loop material by clamping and rotating a belt loop clamped by the loop clamp, and sews the end on a fabric using a needle in a state in which the loop material is folded in a loop shape.

SUMMARY OF INVENTION

In general, a loop through which a shoelace passes is formed in a tongue of a shoe such as sneakers. It is desired to make the loop as small as possible to the extent that the shoelace passes therethrough in order to reduce misalignment of the tongue.

The present invention is made in consideration of the above-mentioned circumstances and an object thereof is to provide a loop material sewing method and a loop sewing machine capable of making a length of a loop as small as possible.

A loop material sewing method of the present invention sews both ends of a belt-shaped loop material on a fabric. The loop material sewing method includes: a one end sewing step of sewing one end of the loop material on the fabric in a state where a front side of the loop material faces the fabric; a fork arranging step of arranging a fork member that includes a pair of fork pins which are extending in parallel, so as to arrange the loop material between the pair of fork pins; a loop folding step of folding an opposite end of the loop material to a back side of the loop material using the pair of fork pins by rotating the fork member around an axial line which is parallel to an extending direction of the pair of fork pins, and relatively moving the fabric and the fork member in a length direction of the loop material; and an opposite end sewing step of arranging the folded opposite end of the loop material on the fabric, pulling out the fork pins from a folded portion at the opposite end of the loop material by moving the fork member in a width direction of the loop material, and sewing the folded opposite end on the fabric.

According to this loop material sewing method, even though a loop material has a short length in the length direction thereof, one end is sewn and then the opposite end is reliably folded using the fork member and is sewn on the fabric. As a result, it is possible to form a loop having a short length by sewing a short loop material on a tongue of a shoe such as a sneaker and to suppress misalignment of the tongue in a state in which a shoelace passes through the loop.

In the loop material sewing method, the pair of fork pins includes a long fork pin and a short fork pin. The long fork pin is longer than the short fork pin by a width of the loop material or more. The fork arranging step arranges the fork member so as to arrange the loop material between the long fork pin and the short fork pin and so as to arrange the long fork pin on the back side of the loop material. The opposite end sewing step arranges the folded opposite end of the loop material on the fabric, pulls out the short fork pin from the folded portion at the opposite end of the loop material by moving the fork member in the width direction of the loop material, pulls out the long fork pin from the folded portion at the opposite end of the loop material by moving the long fork pin to be separated from the one end in the length direction of the loop material and by further moving the fork member in the width direction of the loop material, and sews the folded opposite end on the fabric.

In the loop material sewing method, the pair of fork pins includes a long fork pin and a short fork pin. The long fork pin is longer than the short fork pin by a width of the loop material or more. The fork arranging step arranges the fork member so as to arrange the loop material between the long fork pin and the short fork pin and so as to arrange the long fork pin on the back side of the loop material. The opposite end sewing step arranges the folded opposite end of the loop material on the fabric, pulls out the short fork pin from the folded portion at the opposite end of the loop material by moving the fork member in the width direction of the loop material, pulls out the long fork pin from the folded portion at the opposite end of the loop material by moving the fabric to be separated from the opposite end in the length direction of the loop material and by further moving the fork member in the width direction of the loop material, and sews the folded opposite end on the fabric.

According to this loop material sewing method, in the opposite end sewing step, only the short fork pin is pulled out from the folded portion of the opposite end. Accordingly, it is possible to move the long fork pin to be separated from the one end in the length direction of the loop material while reducing friction between the long fork pin and the loop material, and to form a loop in which the folded portion of the opposite end of the loop material has a short length. As a result, it is possible to suppress a problem in that a folded portion of a loop material interferes with a shoelace for example, when the shoelace passes through the loop.

A loop sewing machine of the present invention sews both ends of a belt-shaped loop material on a fabric. The loop sewing machine includes a sewing mechanism, a clamping mechanism and a fork mechanism. The sewing mechanism sews the loop material on the fabric. The clamping mechanism arranges the loop material at a sewing position of the sewing mechanism by clamping and moving the loop material. The fork mechanism includes a fork member having a pair of fork pins which are extending in parallel and that folds the loop material using the pair of fork pins by rotating the fork member around an axial line parallel to an extending direction of the pair of fork pins in a state where the loop material is between the pair of fork pins. The pair of fork pins includes a long fork pin and a short fork pin. The long fork pin is longer than the short fork pin by a width of the loop material or more.

According to this loop sewing machine, one end of the loop material is arranged at the sewing position and is sewn on the fabric using the sewing mechanism in a state in which the front side of the loop material faces the fabric using the clamping mechanism. Then, the fork member of the fork mechanism is arranged to allow the loop material to pass between the pair of fork pins of the fork member, then the opposite end of the loop material is involved and folded to the back side using the fork pins by rotating the fork member, and the one end of the loop material is folded by relatively moving the fabric and the fork member in the length direction of the loop material. Then, the opposite end of the loop material is arranged on the fabric and the fork pins are pulled out from the folded portion of the opposite end by moving the fork member in the width direction of the loop material and then the folded other end is sewn on the fabric using the sewing mechanism, thereby reliably sewing a short loop material on a fabric. Accordingly, it is possible to form a loop having a short length by sewing a short loop material on the tongue of a shoe such as a sneaker and to suppress misalignment of the tongue in a state in which a shoelace passes through the loop.

A portion in the vicinity of the opposite end of the loop material is caused to pass between the long fork pin and the short fork pin so as to arrange the long fork pin on the back side of the loop material, the opposite end of the loop material which is folded is arranged on the fabric, the fork member is moved in the width direction of the loop material so as to pull out the short fork pin from the folded portion of the opposite end, then the long fork pin is moved to be separated from the one end in the length direction of the loop material, and the fork member is further moved in the width direction of the loop material so as to pull out the long fork pin from the folded portion of the opposite end, the folded other end is sewn on the fabric using the sewing mechanism, thereby forming a loop with the short folded portion. As a result, for example, it is possible to suppress a problem in that a folded portion of the loop material interferes with a shoelace passing through the loop.

According to the present invention, it is possible to provide a loop sewing method and a loop sewing machine capable of decreasing a length of a loop material in the length direction of the loop material.

BRIEF DESCRIPTION OF THE DRAWINGS

FIGS. 6A and 6B are schematic side views of sewn portions of the loop material using a sewing mechanism.

FIGS. 7A to 7I are schematic side views of sewn portions of the loop material using the sewing mechanism.

FIGS. 8A to 8J are schematic perspective views of sewn portions of the loop material using the sewing mechanism respectively.

DETAILED DESCRIPTION

Hereinafter, a loop sewing method and a loop sewing machine according to an embodiment of the present invention will be descried with reference to the accompanying drawings.

Figure 1:
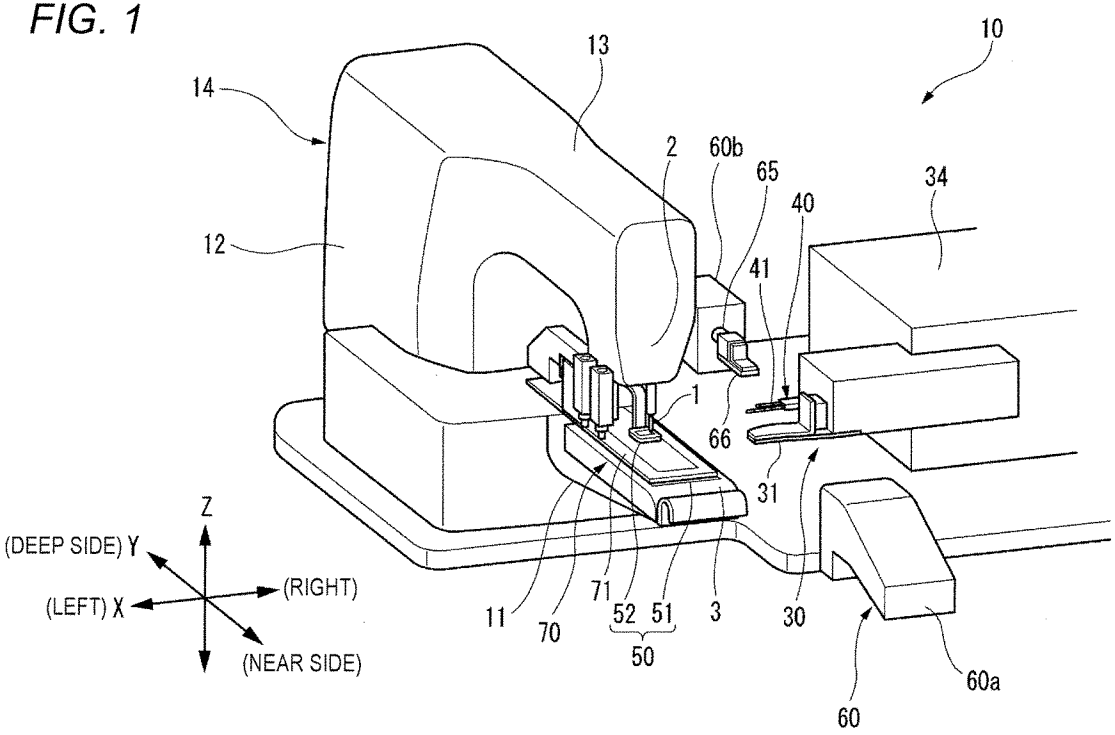
FIG. 1 is a perspective view illustrating an entire configuration of a loop sewing machine according to an embodiment of the present invention.
Figure 2:
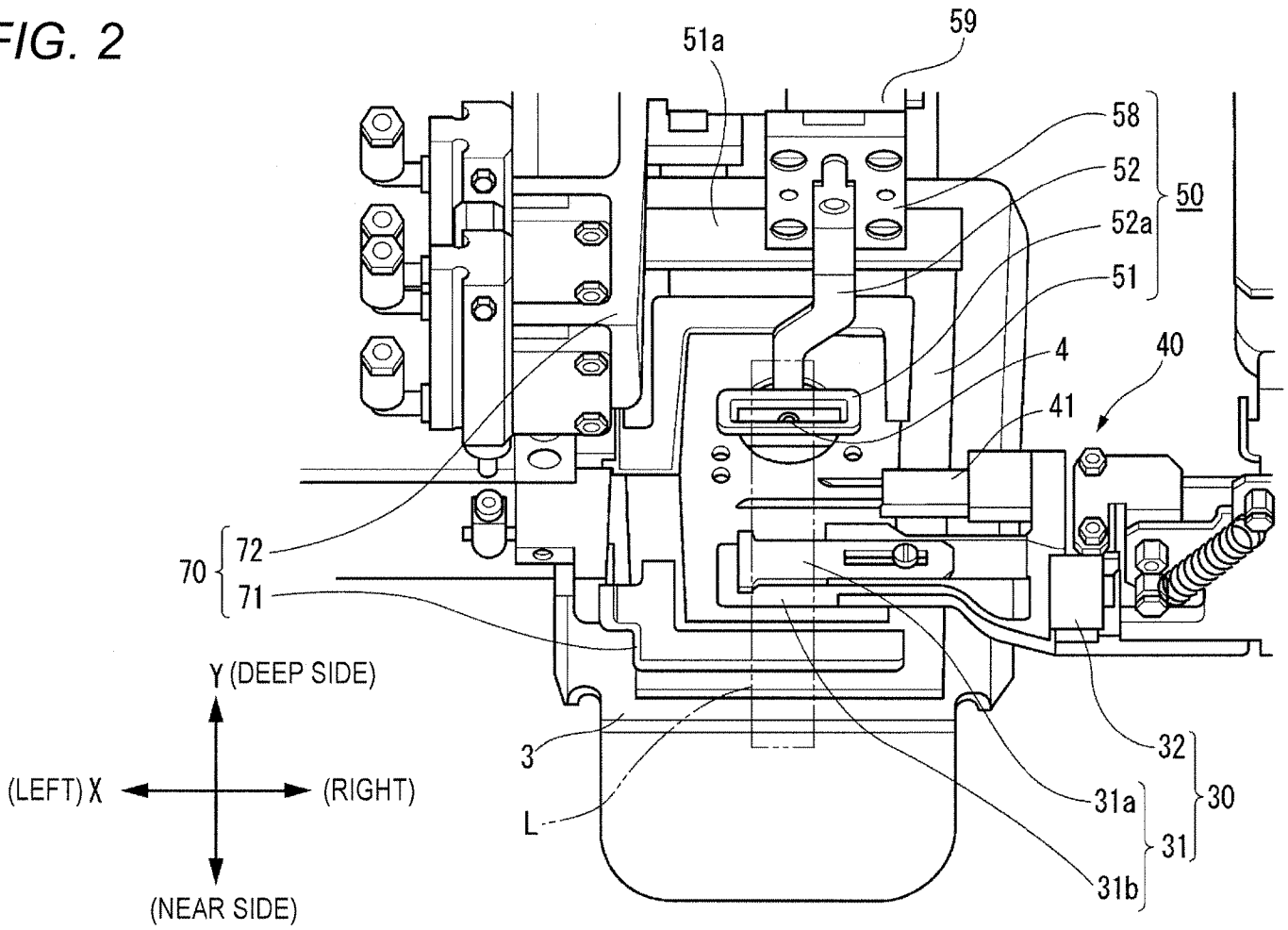
FIG. 2 is a perspective view illustrating the periphery of a needle plate in the loop sewing machine according to the embodiment.
Figure 3:
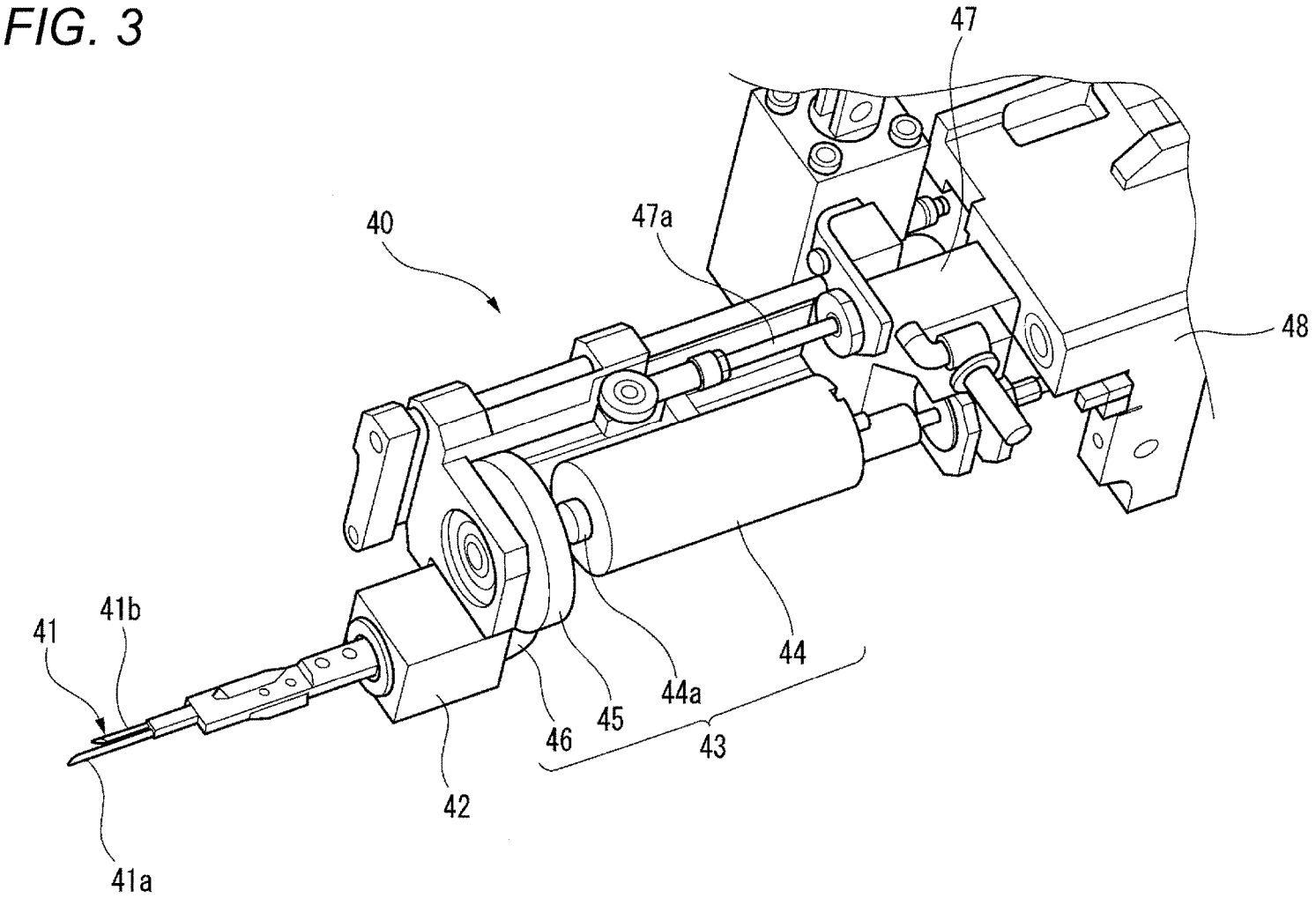
FIG. 3 is a perspective view illustrating a structure of a fork mechanism.
Figure 4:
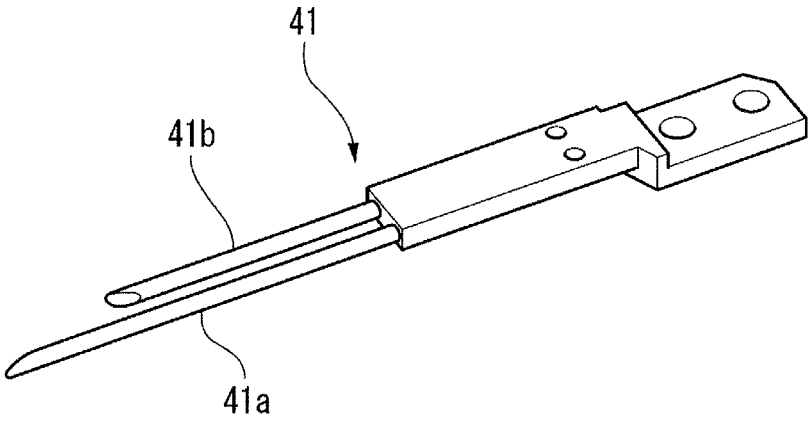
FIG. 4 is a perspective view illustrating a fork member constituting the fork mechanism.
Figure 5:
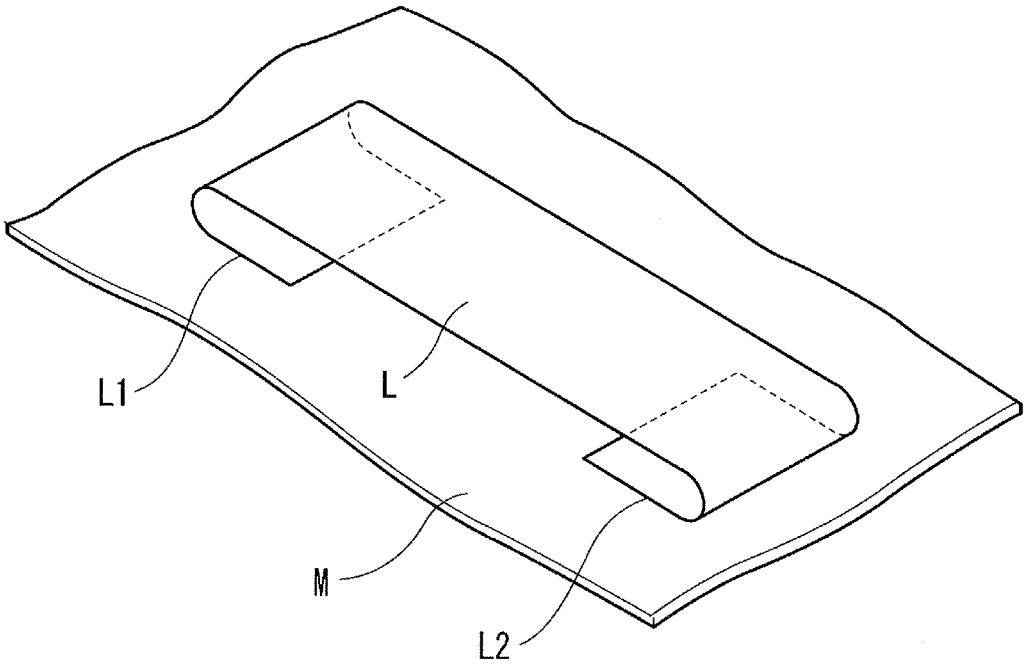
FIG. 5 is a perspective view illustrating a loop formed by sewing a loop material in a loop shape.

FIG. 1 is a perspective view illustrating an entire configuration of a loop sewing machine according to an embodiment of the present invention. FIG. 2 is a perspective view illustrating the periphery of a needle plate in the loop sewing machine according to this embodiment. FIG. 3 is a perspective view illustrating a structure of a fork mechanism. FIG. 4 is a perspective view illustrating a fork member constituting the fork mechanism. FIG. 5 is a perspective view illustrating a loop formed by sewing a loop material in a loop shape.

As illustrated in FIG. 1, a loop sewing machine 10 according to this embodiment includes a sewing machine frame 14 having a bed portion 11, a vertical body portion 12, and an arm portion 13, and driving mechanisms are disposed in the sewing machine frame 14. The loop sewing machine 10 includes a sewing mechanism 2 having a sewing needle 1 at a tip of the arm portion 13, and the sewing mechanism 2 sews a loop material L on a fabric M by moving the sewing needle 1 upward and downward (see FIG. 5). In this way, the loop sewing machine 10 is a sewing machine that sews the loop material L on the fabric M to form a loop.

The loop sewing machine 10 includes a clamping mechanism 30 having a loop clamp 31 that clamps the loop material L facing a predetermined direction, a fork mechanism 40 that folds the loop material L, a loop feed mechanism 60 that feeds the loop material L to the clamping mechanism 30, a loop pressing mechanism 50 including a body feed under-plate 51 supported on a needle plate 3 on which the fabric on which the loop material L is sewn is placed and a loop presser foot 52 that presses down the loop material L by downward movement to the body feed under-plate 51, and a fabric pressing mechanism 70 having a fabric presser foot 71 that holds the fabric M. The loop sewing machine 10 includes a shuttle mechanism (not illustrated) and a controller (not illustrated) that controls the above-mentioned elements.

In the following description, a direction horizontal and parallel to a length direction of the arm portion 13 is defined as an Y-axis direction, a direction horizontal and perpendicular to the Y-axis direction is defined as an X-axis direction, and a vertical direction is defined as a Z-axis direction. If necessary, a surface side of the arm portion 13 as one side in the Y-axis direction is defined as "a near side", and the vertical body portion 12 side as the opposite side in the Y-axis direction is defined as "a deep side". When "right" is mentioned, it represents a direction that is parallel to the X-axis direction and faces the right side when the deep side is viewed from the near side (the surface side), and when "left" is mentioned, it represents a direction that is parallel to the X-axis direction and faces the left side when the deep side is viewed from the near side (the surface side).

Clamping Mechanism

The clamping mechanism 30 is arranged on the right side of the sewing machine frame 14 when the deep side is viewed from the near side (the surface side).

As illustrated in FIG. 2, the clamping mechanism 30 includes a loop clamp 31 having an upper clamp 31*a* and a lower clamp 31*b* that clamp the loop material L, and the loop material L is clamped by the upper clamp 31*a* and the lower clamp 31*b* thereof. The loop material L clamped by the upper clamp 31*a* and the lower clamp 31*b* of the loop clamp 31 is held by the loop clamp 31 in a state in which the length direction thereof is parallel to the Y-axis direction. The loop clamp 31 is supported by a supporting base via a holding block 32. The holding block 32 is movable in the X-axis direction, the Y-axis direction, and the Z-axis direction. As a result, the loop clamp 31 moves to a position along an X-Y plane and to a height along the X-axis direction together with the holding block 32.

Fork Mechanism

The fork mechanism 40 is disposed on the deep side in the Y-axis direction of the clamping mechanism 30. The fork mechanism 40 includes a fork member 41 extending to the left side.

As illustrated in FIGS. 3 and 4, the fork member 41 includes a long fork pin (fork pin) 41*a* and a short fork pin (fork pin) 41*b* which are a pair of shaft-shaped members. The long fork pin 41*a* and the short fork pin 41*b* of the fork member 41 are disposed to be parallel to each other and have different lengths. Specifically, the length of the long fork pin 41*a* is larger by a width dimension of the loop material L and more than the short fork pin 41*b*.

In the long fork pin 41*a* and the short fork pin 41*b*, an axial direction which is an extending direction thereof is set to be parallel to the width direction of the loop material L clamped by the clamping mechanism 30. A base of the fork member 41 is supported by a fork mount 42 disposed in the back of the fork member 41 so as to rotate around an axial line along the extending direction of the long fork pin 41*a* and the short fork pin 41*b*. The fork member 41 is coupled to a rotational drive mechanism 43 for causing the fork member 41 to rotate via the fork mount 42.

The rotational drive mechanism 43 includes a motor 44 of which a rotation phase can be controlled. The motor 44 has a rotary shaft 44*a* arranged to be parallel to the X direction. The rotary shaft 44*a* of the motor 44 is connected to an actuator-side gear 45. The actuator-side gear 45 is rotatably supported by the fork mount 42. A fork-side gear 46 is fixed to a base of the fork member 41 which is rotatably supported by the fork mount 42, and the actuator-side gear 45 engages with the fork side gear 46. The actuator-side gear 45 and the fork-side gear 46 are formed, for example, to have a gear ratio of 3:1. A controller controls the rotational drive of the motor 44 so as to rotate the rotary shaft 44*a* in the forward and reverse directions. As a result, the fork member 41 rotates in the forward and reverse directions via the actuator-side gear 45 and the fork-side gear 46.

An X-direction drive cylinder 47 for causing the fork member 41 to reciprocate in the X direction is disposed in the back of the fork member 41, and a cylinder rod 47*a* of the X-direction drive cylinder 47 is coupled to the fork mount 42. The controller causes the fork member 41 to reciprocate in the X direction via the fork mount 42 by causing the cylinder rod 47*a* of the X-direction drive cylinder 47 to move forward and backward. The fork mechanism 40 is supported by a fork frame 48. The fork frame 48 is movable in the Y-axis direction and the Z-axis direction. Accordingly, the fork mechanism 40 moves to a position in the Y-axis direction and to a height in the Z-axis direction.

Loop Feed Mechanism

As illustrated in FIG. 1, the loop feed mechanism 60 includes a loop feeding portion 60*a* disposed on the near side of the clamping mechanism 30 and a loop pulling portion 60*b* disposed on the deep side of the clamping mechanism 30. The loop pulling portion 60*b* includes loop holding claws 66 holding the loop material L interposed therebetween, and the loop holding claws 66 move forward and backward between a standby position on the deep side of the clamping mechanism 30 and a feed port of the loop feeding portion 60*a* by causing a rod 65 to move forward and backward. The loop feed mechanism 60 holds a tip of the loop material L fed from the feed port of the loop feeding portion 60*a* using the loop holding claws 66 of the loop pulling portion 60*b* serving as a loop holding portion, pulls the tip of the loop material L to the clamping mechanism 30 side, and supplies the loop material L to the clamping mechanism 30 to transfer the loop material L to the loop clamp 31.

Loop Pressing Mechanism

As illustrated in FIG. 2, the body feed under-plate 51 of the loop pressing mechanism 50 is supported by a fabric feed table 59, and is supported on the needle plate 3 so as to be movable in the X-axis direction and the Y-axis direction. At the time of sewing, the fabric M is placed on the top surface of the body feed under-plate 51. The needle plate 3 is a horizontal plane parallel to the X-Y plane and a needle hole 4 into which a sewing needle 1 is inserted is formed at a needle position on the needle plate 3. The fabric feed table 59 of the loop pressing mechanism 50 is moved in the X-axis direction and the Y-axis direction by a drive motor (not illustrated).

A presser foot mount 58 supporting the loop presser foot 52 to be vertically movable is disposed at an operator-side tip of the fabric feed table 59, and the loop presser foot 52 is supported by the fabric feed table 59 via the presser foot mount 58. The body feed under-plate 51 is coupled to a support 72 mounted on the fabric feed table 59 via a connecting plate 51*a*, and the body feed under-plate 51 integrally moves with the fabric feed table 59 in the X-Y directions. Accordingly, the body feed under-plate 51 and the loop presser foot 52 supported by the fabric feed table 59 integrally move with the fabric feed table 59 in the X-Y directions with the movement of the fabric feed table 59. The loop presser foot 52 includes a frame 52*a* having a substantially rectangular shape with a width slightly larger than the width of the loop material L therebelow. The loop presser foot 52 is vertically moved by a pulse motor (not illustrated), holds the loop material L and the fabric M from top to bottom by moving downward, and releases the loop material L and the fabric M by moving upward. The loop pressing mechanism 50 causes the fabric feed table 50 to move in the X-Y directions to arrange the loop material L and the fabric M, which are held on the body feed under-plate 51 by the loop presser 52, at a certain position on the X-Y plane.

Fabric Pressing Mechanism

As illustrated in FIG. 2, the fabric presser foot 71 of the fabric pressing mechanism 70 is disposed in the fabric feed table 59 via the support 72. The support 72 supporting the fabric presser foot 71 is mounted to the fabric feed table 59 so as to be movable in the Y-axis direction. The fabric presser foot 71 is a frame with a substantially C shape in a plan view which is smaller than the needle plate 3 and larger than the frame 52*a* of the loop presser foot 52. The fabric presser foot 71 is disposed on the top surface of the body feed under-plate 51 so as to surround the frame 52*a* of the loop presser foot 52. Since the fabric presser foot 71 is mounted to the fabric feed table 59 via the support 72, the fabric presser foot 71 integrally moves with the fabric feed table 59 with the movement in the X-axis direction and the Y-axis direction of the fabric feed table 59. The fabric presser foot 71 presses and holds the fabric M from top to bottom by moving downward and releases the fabric M by moving upward. The fabric pressing mechanism 70 disposes the fabric M, which is pressed and held on the body feed under-plate 51 by the fabric presser foot 71, at a certain position along a direction (Y-axis direction) directed to the loop material L.

As illustrated in FIG. 5, in the loop sewing machine 10 having the above-mentioned configuration, both ends of the loop material L are folded in a U shape to form a loop shape and are sewn on the fabric M by controlling driving of each mechanism.

A case in which a belt-shaped loop material L is sewn on a fabric M using the loop sewing machine 10 having the above-mentioned configuration will be described below.

Figure 6A:
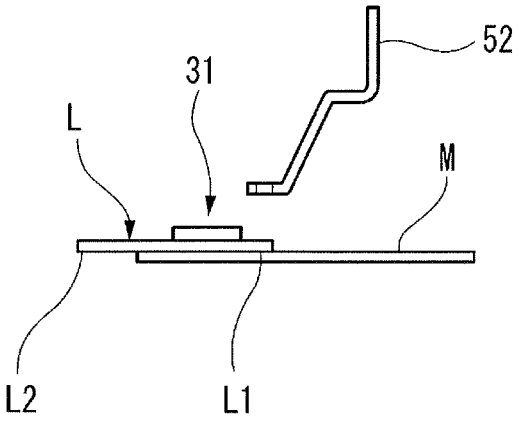
FIGS. 6A and 6B are diagrams illustrating steps of sewing one end of the loop material, where
Figure 6B:
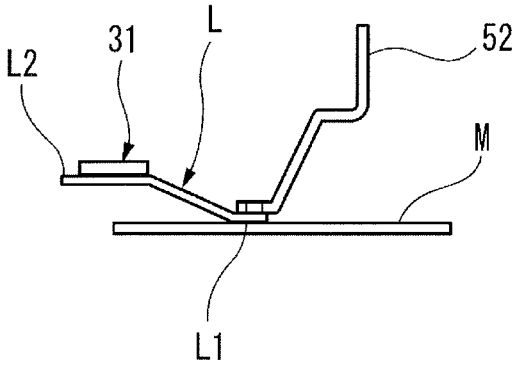

FIGS. 6A and 6B are diagrams illustrating steps of sewing one end of the loop material, where FIGS. 6A and 6B are schematic side views of sewn portions of the loop material using a sewing mechanism. FIGS. 7A to 7I are diagrams illustrating steps of sewing the opposite end of the loop material, where FIGS. 7A to 7I are schematic side views of sewn portions of the loop material using the sewing mechanism. FIGS. 8A to 8J are diagrams illustrating steps of sewing the opposite end of the loop material, where FIGS. 8A to 9J are schematic perspective views of sewn portions of the loop material using the sewing mechanism.

One End Sewing Step

As illustrated in FIG. 6A, the loop clamp 31, which clamps the vicinity of one end L1 in the length direction of a loop material L of which the front side faces a fabric M, moves to a sewing position at which the one end L1 of the loop material L is sewn by the sewing machine 2.

As illustrated in FIG. 6B, the loop presser foot 52 moves downward to press the one end L1 of the loop material L. Thereafter, the loop clamp 31 is separated from the sewing position and the clamping position at which the loop clamp 31 clamps the loop material L moves from the vicinity of the one end L1 of the loop material L to the vicinity of the opposite end L2.

In this state, sewing by the sewing mechanism 2 is started. Then, in the sewing mechanism 2, the sewing needle 1 moves up and down and the fabric presser 71 and the loop presser 52 move to convey the fabric M. Accordingly, the one end L1 of the loop material L is sewn on the fabric M.

Fork Arranging Step

Figure 7A:
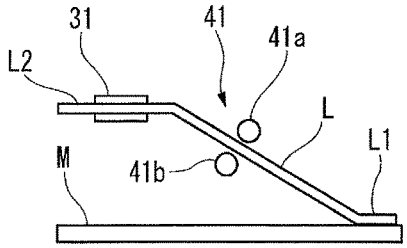
FIGS. 7A to 7I are diagrams illustrating steps of sewing the opposite end of the loop material, where
Figure 8A:
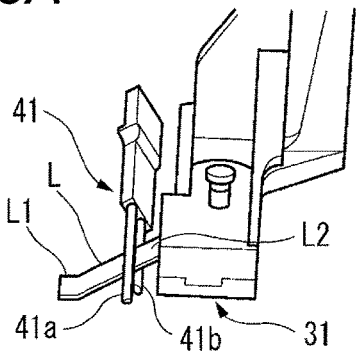
FIGS. 8A to 8J are diagrams illustrating steps of sewing the opposite end of the loop material, where
Figure 8B:
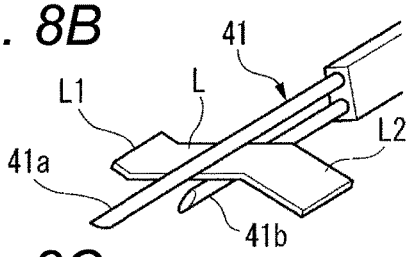

As illustrated in FIGS. 7A, 8A, and 8B, when sewing of the one end L1 of the loop material L is ended, the loop presser foot 52 moves upward to release the pressing of the one end L1 of the loop material L and the fork member 41 moves to the left side in the X-axis direction. Thereafter, the fork member 41 is arranged such that the long fork pin 41*a* is disposed in the back of the loop material L to have the loop material L interposed between the long fork pin 41*a* and the short fork pin 41*b*. It is desirable to arrange the fork member 41 in the vicinity of the opposite end L2 of the loop material L.

Loop Folding Step

Figure 7B:
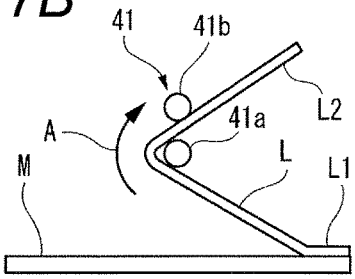
Figure 8C:
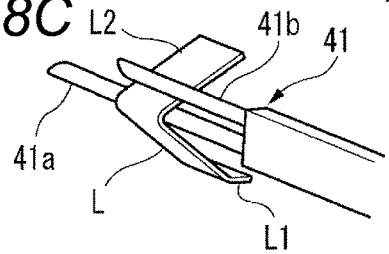

As illustrated in FIGS. 7B and 8C, clamping of the loop clamp 31 which clamps the opposite end L2 of the loop material L is released, the loop clamp 31 moves backward to the right side in the X-axis direction, and the fork member 41 rotates in a positive direction (a direction of an arrow A in FIG. 7B). Accordingly, the vicinity of the opposite end L2 of the loop material L is folded to the back side of the loop material L.

Figure 7C:
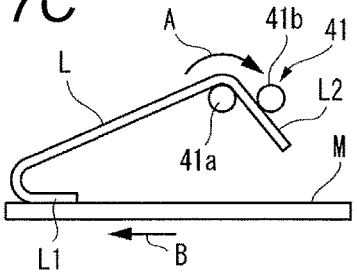
Figure 8D:
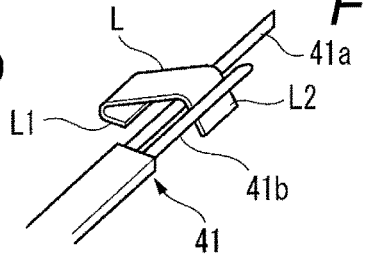

As illustrated in FIGS. 7C and 8D, the fork member 41 further rotates in the positive direction (the direction of the arrow A in FIG. 7C) and the fabric presser foot 71 moves forward (a direction of an arrow B in FIG. 7C) in the Y-axis direction. Accordingly, the one end L1 of the loop material L is arranged to the near side relative to the opposite end L2.

Figure 7D:
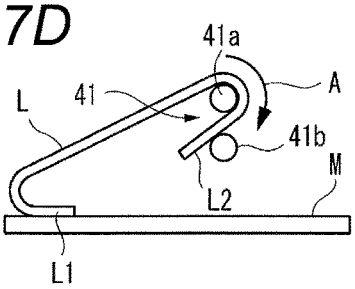
Figure 8E:
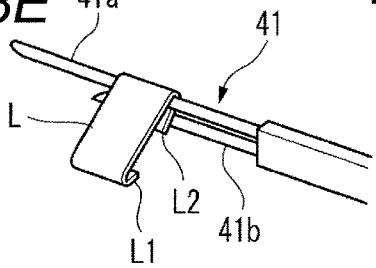

As illustrated in FIGS. 7D and 8E, the fork member 41 further rotates in the positive direction (the direction of the arrow A in FIG. 7D) to involve the opposite end L2 of the loop material L to the back side.

Figure 7E:
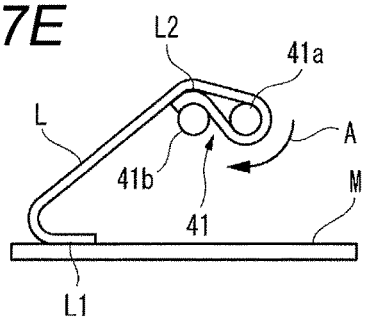
Figure 8F:
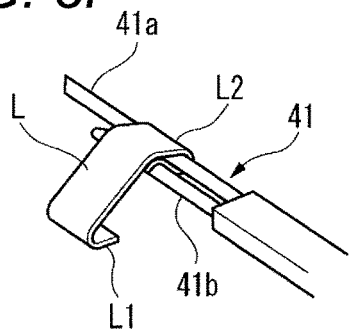

As illustrated in FIGS. 7E and 8F, the fork member 41 further rotates in the positive direction (the direction of the arrow A in FIG. 7E) such that a folded portion of the opposite end L2 of the loop material L is involved to overlap with the vicinity of the opposite end L2.

Opposite End Sewing Step

Figure 7F:
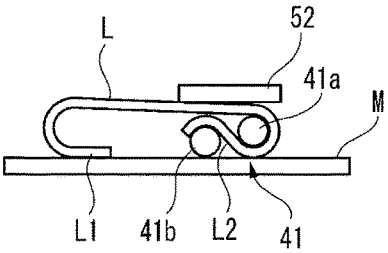
Figure 8G:
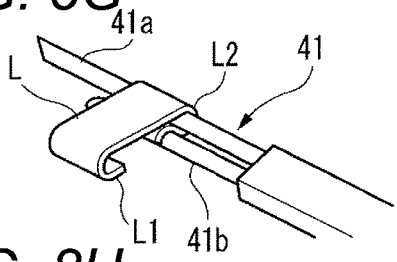

As illustrated in FIGS. 7F and 8G, the fork member 41 moves downward to arrange the folded portion of the opposite end L2 of the loop material L on the fabric M. The loop presser foot 52 moves downward to press the opposite end L2 of the loop material L arranged on the fabric M to the fabric M.

Figure 7G:
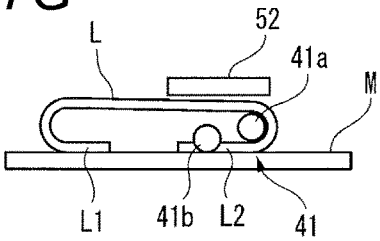
Figure 8H:
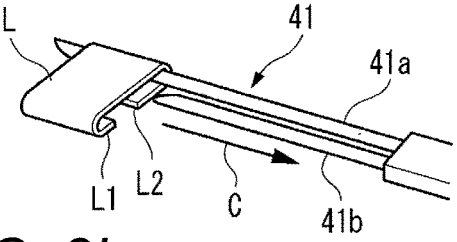

As illustrated in FIGS. 7G and 8H, the loop presser foot 52 slightly moves upward to loosen the pressing of the opposite end L2 of the loop material L, the fork member 41 moves to the right side (a direction of an arrow C in FIG. 8H) in the X-axis direction to pull out the short fork pin 41*b* of the fork member 41 from the folded portion of the opposite end L2 of the loop material L. Then, only the long fork pin 41*a* is arranged in the folded portion of the opposite end L2 of the loop material L.

Figure 7H:
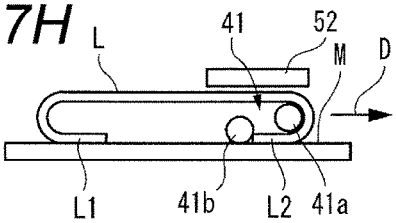
Figure 8I:
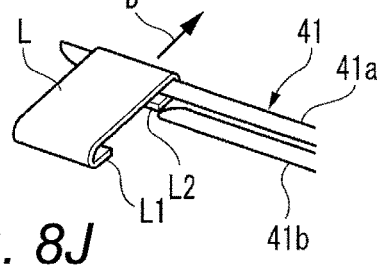

As illustrated in FIGS. 7H and 8I, the fabric presser foot 71 moves to the near side in the Y-axis direction to move the fork member 41 to the deep side (a direction of an arrow D in FIGS. 7H and 8I) in the Y-axis direction relative to the loop material L. Then, the folded portion of the opposite end L2 of the loop material L is displaced in a direction away from the one end L1 and thus the length of the folded portion of the opposite end L2 is reduced. When the length of the folded portion of the opposite end L2 of the loop material L is substantially equal to the length of the folded portion of the one end L1, the fabric presser foot 71 is stopped.

Figure 7I:
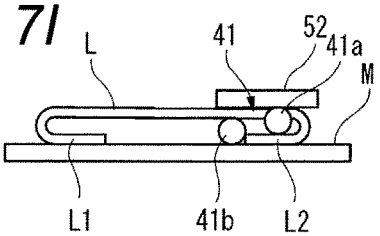
Figure 8J:
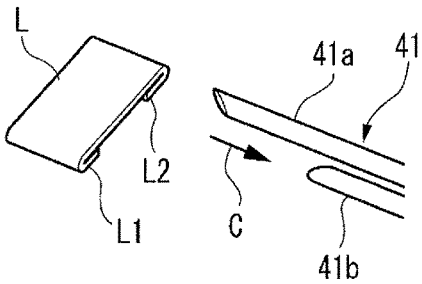

As illustrated in FIGS. 7I and 8J, the fork member 41 moves to the right side (the direction of the arrow C in FIG. 8J) in the X-axis direction to pull out the long fork pin 41*a* of the fork member 41 from the folded portion of the opposite end L2 of the loop material L. Thereafter, the loop presser 52 moves downward to press the opposite end L2 of the loop material L and the sewing by the sewing mechanism 2 is started. Accordingly, the opposite end L2 of the loop material L is sewn on the fabric M.

By performing the above-mentioned steps, the loop material L having a loop shape in which both ends of the loop material L are folded in a U shape is sewn on the fabric M, and thus a loop is formed on the fabric M.

In this embodiment, as described above, the one end L1 of the loop material L is arranged at the sewing position by the clamping mechanism 30 so that the front side faces the fabric M, and is sewn on the fabric M by using the sewing mechanism 2. By arranging the loop material L between the long fork pin 41*a* and the short fork pin 41*b* of the fork member 41 of the fork mechanism 40 and causing the fork member 41 to rotate, the opposite end L2 of the loop material L is folded to the back side using the long fork pin 41*a* and the short fork pin 41*b*. The opposite end L2 of the loop material L is arranged on the fabric M, and the fabric M and the fork member 41 move in the length direction of the loop material L relative to each other. The fork member 41 moves in the width direction of the loop material L to pull out the long fork pin 41*a* and the short fork pin 41*b* from the folded portion of the opposite end L2, and the folded opposite end L2 is sewn on the fabric M using the sewing mechanism 2. By sewing the loop material L on the fabric M through such steps, even though the length of the loop material L is small, the one end L1 is first sewn, then the opposite end L2 is reliably folded by the fork member 41, and the opposite end L2 is sewn on the fabric M. Accordingly, for example, a short loop having a small length of 15 mm to 20 mm can be formed. As a result, it is possible to form a loop having a small length by sewing a short loop material L on a tongue of a shoe such as sneakers and to suppress misalignment of the tongue in a state in which a shoelace passes through the loop.

In the opposite end sewing step, since only the short fork pin 41*b* is pulled out from the folded portion of the opposite end L2 of the loop material L, the friction between the long fork pin 41*a* and the loop material L can be reduced and the long fork pin 41*a* can move in the length direction of the loop material L so as to be separated away from the one end L1. By causing the long fork pin 41*a* to move in the length direction of the loop material L so as to be separated away from the one end L1, it is possible to form a loop L in which the length of the folded portion of the opposite end L2 of the loop material L decreases to about, for example, 5 mm which is the same length as the folded portion of the one end L1. Accordingly, for example, it is possible to suppress a problem in that a folded portion of a loop material interferes with a shoelace passing through the loop.

What is claimed is:

1. A loop material sewing method of sewing both ends of a belt-shaped loop material on a fabric, the loop material sewing method comprising:

a one end sewing step of sewing one end of the loop material on the fabric in a state where a front side of the loop material faces the fabric;

a fork arranging step of arranging a fork member that includes a pair of fork pins which are extending in parallel, so as to arrange the loop material between the pair of fork pins;

a loop folding step of folding an opposite end of the loop material to a back side of the loop material using the pair of fork pins by rotating the fork member around an axial line which is parallel to an extending direction of the pair of fork pins, and relatively moving the fabric and the fork member in a length direction of the loop material; and an opposite end sewing step of arranging the folded opposite end of the loop material on the fabric, pulling out the fork pins from a folded portion at the opposite end of the loop material by moving the fork member in a width direction of the loop material, and sewing the folded opposite end on the fabric, wherein:

the pair of fork pins includes a long fork pin and a short fork pin;

the long fork pin is longer than the short fork pin by a width of the loop material or more;

the fork arranging, step arranges the fork member so as to arrange the loop material between the long fork pin and the short fork pin and so as to arrange the long fork pin on the back side of the loop material; and the opposite end sewing step arranges the folded opposite end of the loop material on the fabric, pulls out the short fork pin from the folded portion at the opposite end of the loop material by moving the fork member in the width direction of the loop material, pulls out the long fork pin from the folded portion at the opposite end of the loop material by moving the long fork pin to be separated from the one end in the length direction of the loop material and by further moving the fork member in the width direction of the loop material, and sews the folded opposite end on the fabric.

2. A loop material sewing method of sewing both ends of a belt-shaped loop material on a fabric, the loop material sewing method comprising:

a one end sewing step of sewing one end of the loop material on the fabric in a state where a front side of the loop material faces the fabric;

a fork arranging step of arranging a fork member that includes a pair of fork pins which are extending in parallel, so as to arrange the loop material between the pair of fork pins;

a loop folding step of folding an opposite end of the loop material to a back side of the loop material using the pair of fork pins by rotating the fork member around an axial line which is parallel to an extending direction of the pair of fork pins, and relatively moving the fabric and the fork member in a length direction of the loop material; and an opposite end sewing step of arranging the folded opposite end of the loop material on the fabric, pulling out the fork pins from a folded portion at the opposite end of the loop material by moving the fork member in a width direction of the loop material, and sewing the folded Apposite end on the fabric wherein:

the pair of fork pins includes a long fork pin and a short fork pin;

the long fork pin is longer than the short fork pin by a width of the loop material or more;

the fork arranging step arranges the fork member so as to arrange the loop material between the long fork pin and the short fork pin and so as to arrange the long fork pin on the back side of the loop material; and the opposite end sewing step arranges the folded opposite end of the loop material on the fabric, pulls out the short fork pin from the folded portion at the opposite end of the loop material by moving the fork member in the width direction of the loop material, pulls out the long fork pin from the folded portion at the opposite end of the loop material by moving the fabric to be separated from the opposite end in the length direction of the loop material and by further moving the fork member in the width direction of the loop material, and sews the folded opposite end on the fabric.

3. A loop sewing machine which sews both ends of a belt-shaped loop material on a fabric, the loop sewing machine comprising:

a sewing mechanism that sews the loop material on the fabric;

a clamping mechanism that arranges the loop material at a sewing position of the sewing mechanism by clamping and moving the loop material; and a fork mechanism that includes a fork member having a pair of fork pins which are extending in parallel and that folds the loop material using the pair of fork pins by rotating the fork member around an axial line parallel to an extending direction of the pair of fork pins in a state where the loop material is between the pair of fork pins, wherein the pair of fork pins includes a long fork pin and a short fork pin, the long fork pin is longer than the short fork pin by a width of the loop material or more, wherein the fork mechanism is configured to pull out the short fork pin from a folded portion of the loop material after the fork mechanism folds the loop material, and the fork mechanism is configured to move the long fork pin or the fabric in a state where only the long fork pin is arranged in the folded portion.

* * * * *